US007618248B2

(12) United States Patent
Mosemann et al.

(10) Patent No.: US 7,618,248 B2
(45) Date of Patent: Nov. 17, 2009

(54) SCREW COMPRESSOR WITH INTERMEDIATE PLATE

(75) Inventors: Dieter Mosemann, Schildow (DE); Dmytro Zaytsev, Berlin (DE); Ottomar Neuwirth, Berlin (DE)

(73) Assignee: Grasso GmbH Refrigeration Technology, Berlin (DE)

( * ) Notice: Subject to any disclaimer, the term of this patent is extended or adjusted under 35 U.S.C. 154(b) by 0 days.

(21) Appl. No.: 11/801,158

(22) Filed: May 9, 2007

(65) Prior Publication Data

US 2007/0264146 A1 Nov. 15, 2007

(30) Foreign Application Priority Data

May 10, 2006 (DE) ..... 10 2006 021 704

(51) Int. Cl.
*F01C 1/16* (2006.01)
*F03C 2/00* (2006.01)

(52) U.S. Cl. ..... 418/201.1; 418/132; 418/201.3

(58) Field of Classification Search ..... 418/131, 418/132, 201.1, 201.3, 75
See application file for complete search history.

(56) References Cited

U.S. PATENT DOCUMENTS 2,578,196 A * 12/1951 Montelius ..... 418/203
4,443,170 A 4/1984 Schibbye
4,938,672 A * 7/1990 Ingalls ..... 418/201.3
5,096,399 A 3/1992 Mosemann
5,674,063 A * 10/1997 Ozaki et al. ..... 418/201.3
6,328,546 B1 12/2001 Uishi
6,519,967 B1 2/2003 Mosemann et al.

FOREIGN PATENT DOCUMENTS

EP 42027 A1 * 12/1981
GB 648055 * 11/1948
GB 1335025 * 10/1973
JP 54011511 A * 1/1979
JP 54039209 A * 3/1979

OTHER PUBLICATIONS

U.S. Appl. No. 11/801,150, filed May 9, 2007, Dieter Mosemann et al.
U.S. Appl. No. 11/801,188, filed May 9, 2007, Dieter Mosemann et al.

* cited by examiner

*Primary Examiner*—Theresa Trieu
(74) *Attorney, Agent, or Firm*—Horst M. Kasper

(57) ABSTRACT

The invention relates to oil-flooded screw compressors having a male rotor and female rotor each featuring preferably a ratio of male-to-female rotor lobes of 4:6, 5:6 or 5:7. In order to decrease the bearing load at higher working pressures, the profile sections of the rotors are shortened, and an intermediate plate is appropriately arranged in the free space formed.

22 Claims, 4 Drawing Sheets

SCREW COMPRESSOR WITH INTERMEDIATE PLATE

FIELD OF THE INVENTION

Figure 1:
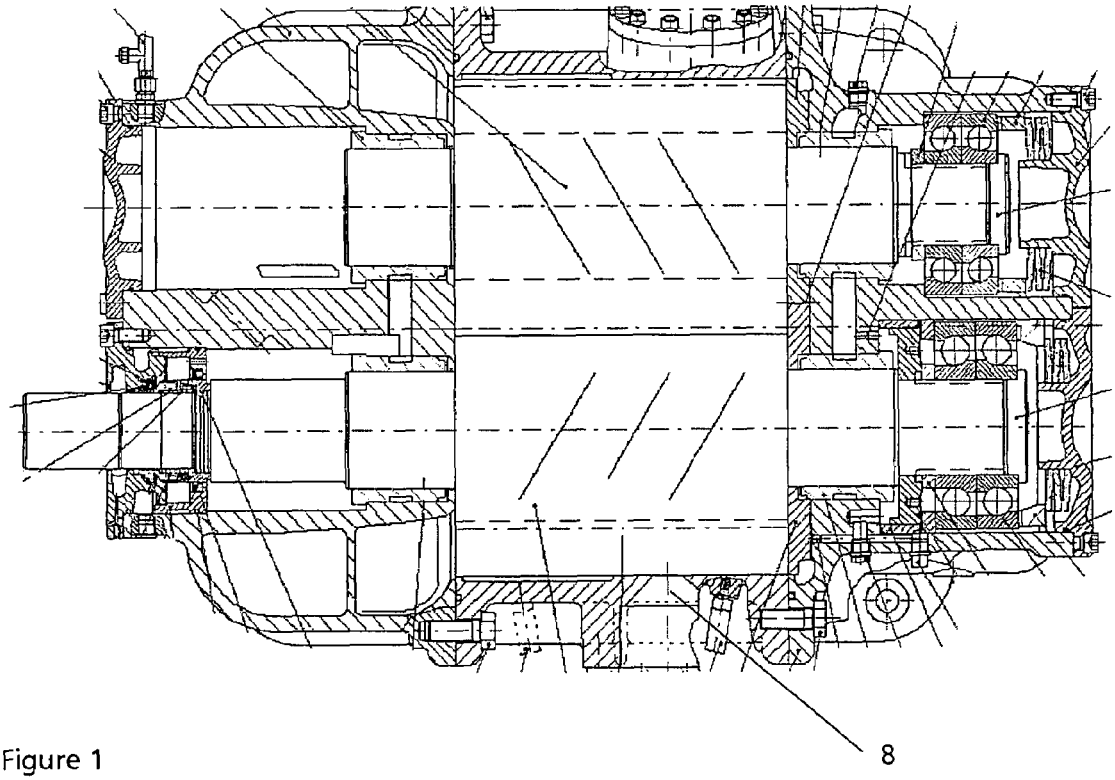

The invention relates to oil-flooded screw compressors for high input power. Such screw compressors have two parallel rotors: a male rotor having essentially convex lobe flanks featuring four, five or six lobes, and a female rotor having essentially concave lobe flanks featuring six or seven lobes; the male rotor has a drive-shaft end and both rotors are enclosed in housing sections: a suction-housing section having at least parts of a suction channel and parts of an inlet port for passing of the working fluid into the interlobe spaces of the rotor pair, a rotor-housing section at least partially enclosing the profile section of the rotors, and a discharge housing having at least an outlet port for passing the gas out of the interlobe spaces of the rotor pair due to rotation of the rotors, and a discharge channel.

Such screw compressors have a working space designated also as working chamber or working cavity formed by the interlobe spaces of both rotors, adjacent housing sections and other adjacent components such as e.g. a control slide. The suction channel and the inlet port are adjacent to the working chambers on the suction side. One or several outlet ports are adjacent to the working chambers on the discharge side. The rotors have shaft extensions enclosed in radial- and/or axial bearings.

DESCRIPTION OF THE RELATED ART

The compressor drive-shaft end and the radial- and axial bearings are loaded more or less depending on the compressor size, the suction- and discharge pressure. The distance between both rotor axes determines the maximum bearing size and hence the load-carrying ability of the bearings with respect to a pre-defined service life of the bearings.

There is a relationship between the input power and bearing load for an existing compressor. When the input power rises which is the case at higher working pressures, the torsional moment at the drive-shaft end as well as the load on the radial- and axial bearings will increase. This results in a limitation of the conditions of application for the known compressors.

The screw compressors used so far having four or five lobes on the male rotor and six or seven lobes on the female rotor with a wrap angle on the male rotor of approx. 300° are not capable to accommodate extremely high input power as the bearings of the rotors do not reach an acceptable service life due to the high loads. According to prior art, the input power of an existing compressor is limited for such compressors to working pressures of approx. 40 bar. For higher working pressures, the compressor would have to be operated in the part-load mode which would cause additional losses and hence higher operating cost.

Therefore, compressors with a greater number of lobes have been developed for this case of application and introduced into the market. They have a ratio of six lobes on the male rotor to seven or eight lobes on the female rotor with a wrap angle of approx. 300° at the profile section of the male rotor.

These compressors have smaller working cavities. Hence, the loads on both the radial- and axial bearings are less compared to the first-mentioned compressors having ratios of male-to-female rotor lobes of 4:6 or 5:6 or 5:7 respectively. A drawback is that the internal leakage of such compressors increases compared to the first-mentioned compressors having greater working cavities and ratios of male-to-female rotor lobes of 4:6, 5:6 or 5:7.

The internal leakage, which can be demonstrated by a geometric relationship between the meshing line length and the volume of the working cavity increases on compressors having a ratio of male-to-female rotor lobes of 6:8 by the factor 2 to 3 in comparison with the first-mentioned compressors so that the efficiency, i.e. the volumetric efficiency and the isentropic efficiency, and hence the efficiency of energy conversion of the compressor, will be reduced.

SUMMARY OF THE INVENTION

The object of the invention is to prevent the disadvantages mentioned and to generate a screw compressor wherein the internal leakage does not worsen and wherein the input power of the compressor and its impact on the bearing loads are brought into a range so as to achieve a sufficient service life required for industrial applications.

A further object of the invention is, for reasons of component standardization and cost reduction, to use compressor components such as bearing assemblies of existing compressors designed for smaller pressure gradients between the suction- and discharge sides.

The feature of the invention is to use rotors having a ratio of male-to-female rotor lobes of 4:6, 5:6 or 5:7 as before and to reduce the ratio L/A between the length of the profile section of the rotors L and distance between the rotor axes A, which determines the bearing load, by shortening the profile sections of both rotors compared with known compressors. In order to use the same rotor-housing section, an intermediate plate is fixed at the suction housing adjacent to the working chamber on the suction side. The intermediate plate consists of a similar material as the material of the housings, cast grey iron or steel, or aluminium or another rigid material suitable for refrigerants and oil.

The intermediate plate furnishes parts of the suction channel at the male rotor side and at the female rotor side. It continues the suction channel in axial direction from the suction housing to the grooves of the rotor profile of male and female rotor. Another feature of the intermediate plate is characterized by location of parts of oil return channels for oil drainage from bearings or shaft seals or combinations of this to grooves of the rotor profile of the male rotor and of the female rotor. The intermediate plate seals the grooves of the rotor profile of male and female rotor at the end face of the rotor pair without direct contact. Male rotors of compressors according to the invention have wrap angles in the range of approximately 140° to 250°. The wrap angle is defined as the angle between the two end face sides of the rotor profile measured around the rotor axis, the wrap angle represents the twist of rotor profile between the suction and discharge end faces. During rotation between the suction process and the beginning of compression, the rotor pair has a transfer phase, i.e. a phase without geometric change of volume of the working cavity. The ratio L/A between the length of the profile section of the rotors L and distance between the rotor axes A lies approximately between 0.7 to 1.3.

The advantage of the invention is that the inlet port shape is preferably defined so that the suction process is terminated after the maximum volume of the working cavity has been reached and before the cavity starts to decrease as a result of rotor rotation, i.e. within the transfer phase. Therefore, the additional volume flow may be admitted within the transfer phase of compressor versions with economizers. Thus, the refrigerating capacity is preferably increased compared to compressor versions with economizers and without transfer phase. A further advantage of the solution according to the invention is that the screw compressor compared to another known solution with shortening of one rotor only (U.S. Pat. No. 6,328,546) features a defined displacement volume independent of the operation conditions.

A further advantage is that from an existing compressor designed for smaller input power the components such as bearings and rotor housing can be used and tools and appliances for manufacture of components such as rotors with their profiles, and the housing can be reused so as to reduce costs for the manufacture of compressors due to standardization of components, tools and manufacturing auxiliaries. Compressors according to the invention have preferably the same connection dimensions as have compressors of smaller input power.

DESCRIPTION OF THE EXEMPLARY EMBODIMENTS

In the following, the invention is described in an example of embodiment. The accompanying drawing shows in:

FIG. 1 a screw compressor of known design.

Figure 2:
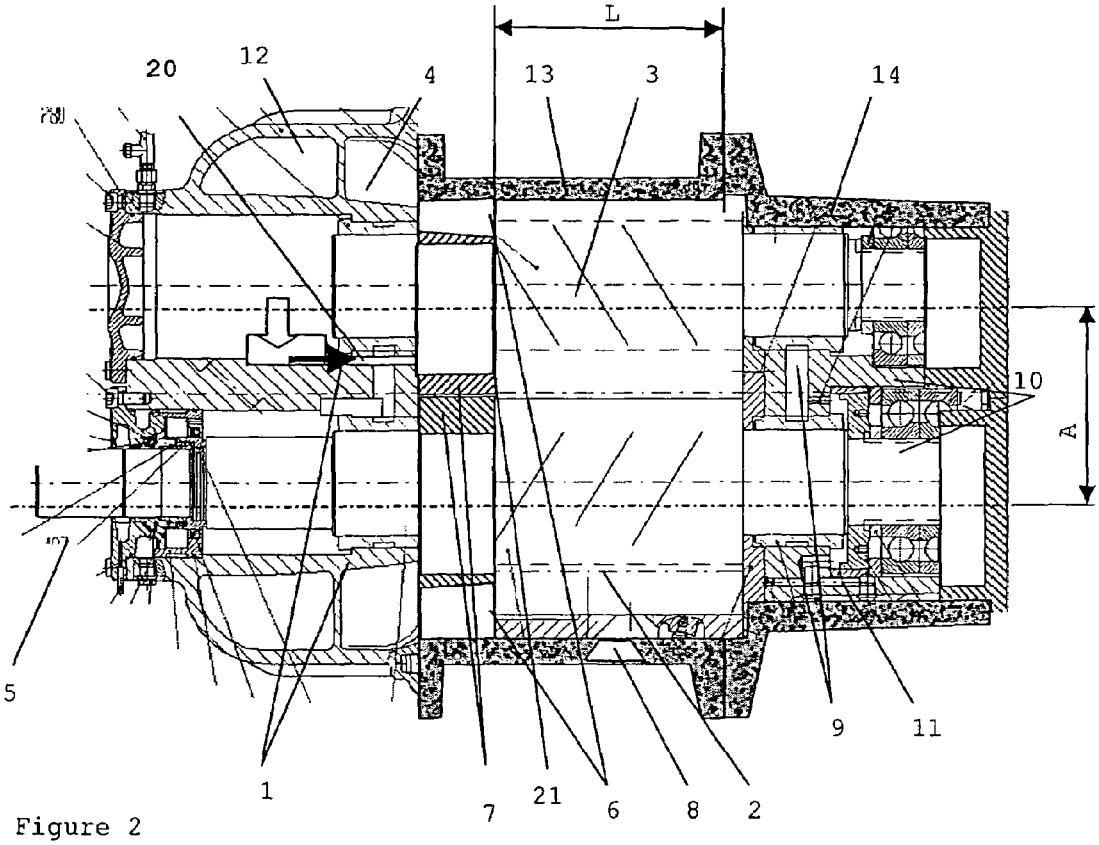

FIG. 2 a screw compressor according to the invention.

Figure 3:
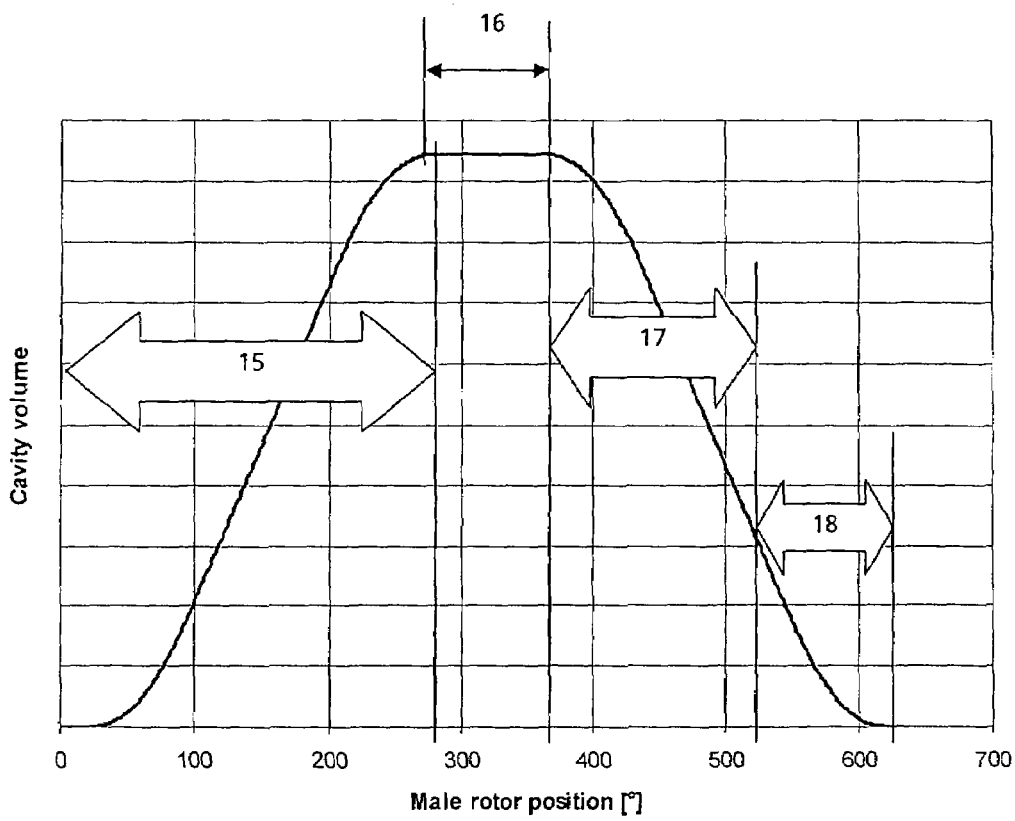

FIG. 3 the working cavity volume as a function of the male rotor position for a screw compressor according to the invention.

Figure 4:
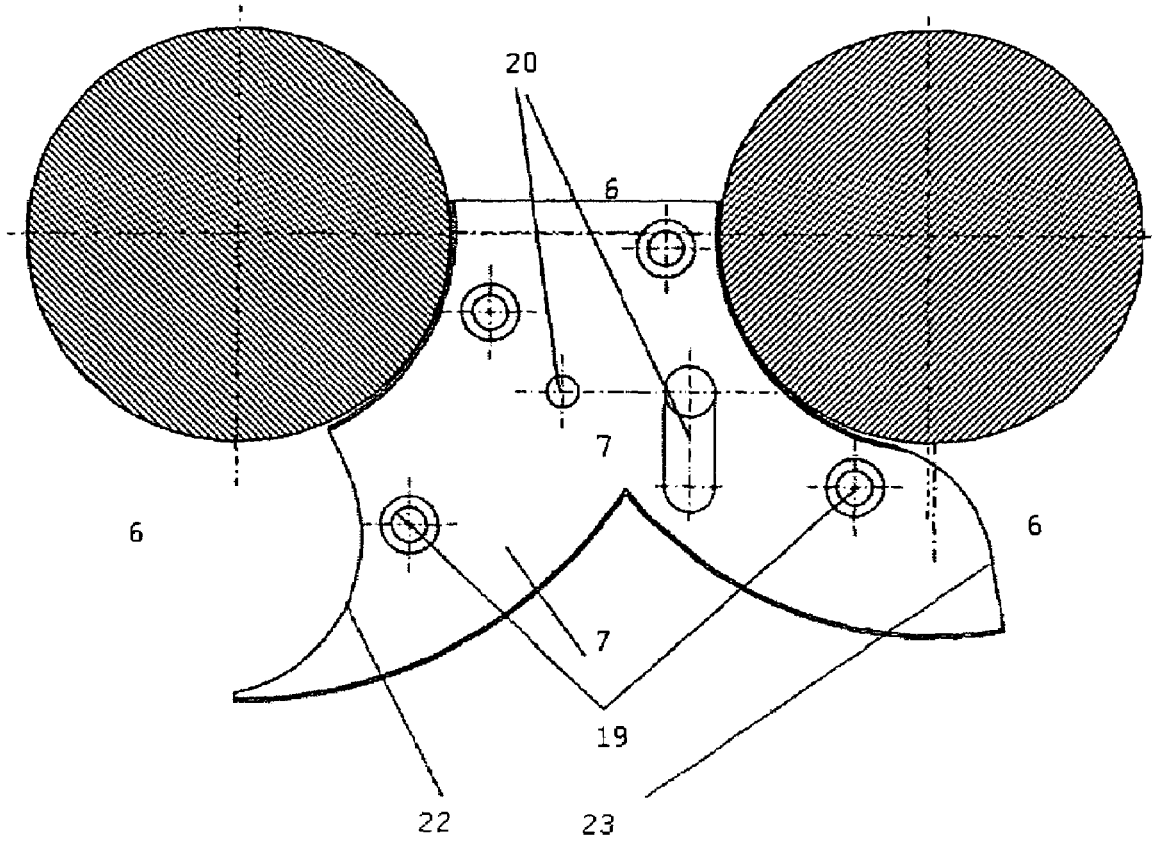

FIG. 4 an sample of an intermediate plate according the invention.

In the screw compressor shown in FIG. 2 according to the invention, the same components as in the known compressor are used to a large extent. The compressor is driven via a coupling not shown at the drive-shaft end 5, which is a fixed part of the male rotor 2. The interlobe spaces of the five-lobe male rotor 2 the profile section of which has a wrap angle of 180° and the six-lobe female rotor 3 the profile section of which has a wrap angle of 150°, form working cavities, to which adjoins according to the invention on the suction side in the rotor-housing section 13 the intermediate plate 7, which can comprise two parts for the male- and female-rotor side and incorporates parts of suction channel 4 with inlet port 6 and oil return channel 20. The ratio L/A between the length of the profile section of the rotors L and distance between the rotor axes A lies approximately between 0.7 and 1.3. The intermediate plate 7 seals grooves of the rotor profile of the male rotor 2 and of the female rotor 3. The intermediate plate 7 furnishes a location for parts of an oil return channel 20 for oil drainage from bearings or for oil drainage from bearings and shaft seals both to grooves of the rotor profile of the male rotor 2 and of the female rotor 3. The thickness of the intermediate plate 7 can be at least one tenth times the length L of the rotor profile of the male rotor 2 and of the female rotor 3. The intermediate plate 7 is sandwiched between the suction housing section and a suction side end of the rotor profile of the rotor pair. Advantageously, only a single intermediate plate 7 is employed. The intermediate plate 7 can be a single piece of planar material. The single piece can be disposed between a first shaft of the male rotor 2 and a second shaft of the female rotor 3. A first contour 22 of the intermediate plate 7 follows closely a round periphery of the first shaft over an angle of more than 60 degrees. A second contour 23 of the intermediate plate 7 follows closely around a periphery of the second shaft over an angle of more than 60 degrees. More than 90 percent of the intermediate plate 7 can be disposed on one side of a connection line between axes of male rotor 2 and female rotor 3.

Due to rotation of the rotors, the volume of a working cavity considered increases (suction process 15), then remains constant for a range of the angle of rotation (transfer phase 16), and decreases (compression process 17 and discharge process 18). Due to the shape of the inlet port, the latter gets disconnected from the working cavity considered as a result of rotor rotation, after the transfer phase 16 has begun.

The compressor can be fitted with an economizer port 8 on the wall of the housing enclosing the rotors between the suction- and discharge side of the compressor, preferably arranged in the area of the transfer phase 16 of the working cavity after the disconnection of the working cavity from the suction port.

Both rotors 2 and 3 are supported by radial bearings 1 on the suction side and by radial bearings 9 and axial bearings 10 on the discharge side. For compensation of the axial thrust, a contactless sealing rotating balance piston 11 is arranged on male rotor 2. Balance piston 11 is supplied with pressurized oil and axially counteracts the gas force exerting on male rotor 2.

The intermediate plate 7 is fixed with fixation screws 19 at the suction housing adjacent to the working chamber on the suction side. The intermediate plate 7 consists of a similar material as the material of the housings, cast grey iron or steel, or aluminum, or another rigid material suitable for refrigerants and oil.

The intermediate plate 7 furnishes parts of the suction channel 6. The contour 22 of the intermediate plate 7 at the male rotor side is adapted to the shape of the male rotor groove at its suction face side. The contour 23 of the intermediate plate 7 at the female rotor side is adapted to the shape of the female rotor groove at its suction face side. It continues the suction channel 6 in axial direction from the suction housing to the grooves of the rotor profile of male and female rotor. The position of contour 22 and of contour 23 finishes the suction stroke and defines the beginning of the transportation stroke. Another feature of the intermediate plate is characterized by location of parts of oil return channels 20 for oil drainage from bearings or shaft seal or combinations of this to grooves of the rotor profile of male rotor and female rotor. Oil return channels 20 are arranged related to the contour 22 and the contour 23 in a way that returned oil from sleeve bearings 1 and shaft seal is led off into closed working chambers. The intermediate plate 7 seals the grooves of the rotor profile of male rotor and female rotor at the end face 21 of the rotor pair without direct contact.

LIST OF REFERENCE NUMERALS USED

1 Radial bearing
2 Male rotor
3 Female rotor
4 Suction channel
5 Drive-shaft end
6 Inlet port
7 Intermediate plate
8 Economizer port
9 Radial bearing
10 Axial bearing
11 Balance piston
12 Suction-housing section
13 Rotor-housing section
14 Discharge-housing section
15 Suction process
16 Transfer phase
17 Compression process
18 Discharge process

19 Fixation screws
20 Channels of oil drainage
21 End face of rotors
A Distance between the rotor axes
L Length of the profile section of the rotors

What we claim is:

1. Oil-flooded screw compressor for high input power featuring two rotors, a male rotor (2) having essentially convex lobe flanks featuring four, five or six lobes, and a female rotor (3) having essentially concave lobe flanks featuring six or seven lobes, with the male rotor having a drive-shaft end (5), and both rotors are enclosed in housing sections: a suction-housing section (12) having at least parts of a suction channel (4) for passing of the working fluid into interlobe spaces of the rotor pair, a rotor-housing section (13) at least partially enclosing a profile section of the rotors (2) and (3), and a discharge-housing section (14) having at least an outlet port for passing gas out of the interlobe spaces of the rotor pair due to rotation of the rotors (2) and (3), and a discharge channel, wherein a ratio L/A between a length L of the profile section of the rotors and distance A between the rotor axes, which determines the bearing load, is decreased by shortening the profile sections of both rotors, and adjacent to the suction side of the profile section of the rotors an intermediate plate (7) is fixed relative to the rotor-housing section (13) containing parts of the suction channel (4) with inlet port (6), sealing the end face of the profile section of the rotors contactless, and filling appropriately a space formed by shortening of the profile sections of the rotors.

2. Screw compressor according to claim 1 wherein the male rotor (2) of the compressor according to the invention has a wrap angle in the range of approximately 140° to 250° and wherein the intermediate plate (7) is disposed opposite to and partly covering the ends of the male rotor and the female rotor on the suction side.

3. Screw compressor according to claim 1 wherein the length L of the profile sections of the rotors of the compressor according to the invention has a ratio to the distance A between rotor axes of 0.7 to 1.3 and wherein a first contour (22) of the intermediate plate (7) at the male rotor side is adapted to a shape of the male rotor groove at its suction face side and wherein a second contour (23) of the intermediate plate (7) at the female rotor side is adapted to the shape of the female rotor groove at its suction face side.

4. Screw compressor according to claim 1 wherein the intermediate plate (7) is arranged within the rotor-housing section (13) and wherein the intermediate plate (7) covers an angular sector of less than 180 degrees of the end of the male rotor on the suction side and an angular sector of less than 180 degrees of the end of the female rotor on the suction side.

5. Screw compressor according to claim 1 wherein an economizer port (8), has a connection to the working cavity within the transfer phase (16).

6. Screw compressor according to claim 1 wherein the male rotor (2) of the screw compressor has five lobes and a wrap angle in the range of approximately 140° to 250°.

7. An oil-flooded screw compressor for high input power comprising a male rotor (2) having essentially convex lobe flanks featuring four, five or six lobes;

a female rotor (3) having essentially concave lobe flanks featuring six or seven lobes, a drive-shaft end (5) formed at the male rotor (2); wherein the male rotor (2) and the female rotor (3) form a rotor pair;

a suction-housing section (12) having at least parts of a suction channel (4) for passing of a working fluid into interlobe spaces of the rotor pair;

a rotor-housing section (13) at least partially enclosing a profile section of the male rotor (2) and of the female rotor (3);

a discharge-housing section (14) having at least an outlet port for passing a gas out of the interlobe spaces of the rotor pair due to rotation of the male rotor (2) and of the female rotor (3), and a discharge channel, wherein the suction housing section (12), the rotor housing section (13), and the discharge housing section (14) enclose the male rotor (2) and the female rotor (3);

a ratio L/A between a length L of a profile section of the male rotor (2) and of the female rotor (3) and distance A between axes of the rotor pair, which ratio L/A determines a bearing load, is decreased by shortening the profile sections of the male rotor (2) and of the female rotor (3); and an intermediate plate (7) fixed adjacent to the suction side of the profile section of the rotor pair relative to the rotor-housing section (13) containing parts of the suction channel (4) with inlet port (6), sealing contactless an end face of the profile sections of the rotor pair, and filling appropriately a space formed by shortening of the profile sections of the rotor pair.

8. The screw compressor according to claim 7 wherein the male rotor (2) of the compressor according to the invention has a wrap angle in the range of approximately 140° to 250°.

9. The screw compressor according to claim 7 wherein the length L of the profile sections of the rotors of the compressor according to the invention has a ratio to the distance A between rotor axes of 0.7 to 1.3.

10. The screw compressor according to claim 7 wherein the intermediate plate (7) is arranged within the rotor-housing section (13).

11. The screw compressor according to claim 10 wherein the intermediate plate (7) is fixed at the suction housing section (12) adjacent to a working chamber on the suction side; wherein the intermediate plate (7) is made of a similar material to the material of the suction-housing section (12), the rotor-housing section (13), and of the discharge-housing section (14).

12. The screw compressor according to claim 11 wherein the intermediate plate (7) is made of a material selected from the group consisting of cast grey iron, steel, and aluminum.

13. The screw compressor according to claim 10 wherein the intermediate plate is made of a rigid material suitable for refrigerants and oil; wherein the intermediate plate (7) contains parts of the suction channel (4).

14. The screw compressor according to claim 10 wherein the intermediate plate (7) continues the suction channel (4) in axial direction from the suction housing section (12) to grooves of the rotor profile of the male rotor (2) and of the female rotor (3).

15. The screw compressor according to claim 10 wherein the intermediate plate (7) furnishes a location for parts of an oil return channel (20) for oil drainage from bearings to grooves of the rotor profile of the male rotor (2) and of the female rotor (3).

16. The screw compressor according to claim 10 wherein a thickness of the intermediate plate (7) is at least one tenth times the length L of the rotor profile of the male rotor (2) and of the female rotor (3);

wherein the intermediate plate is sandwiched between the suction housing section and a suction side end of the rotor profile of the rotor pair; and wherein only a single intermediate plate (7) is employed.

17. The screw compressor according to claim 7 wherein an economizer port (8), has a connection to the working cavity within the transfer phase (16).

18. The screw compressor according to claim 7 wherein the male rotor (2) of the screw compressor has five lobes and a wrap angle in the range of approximately 140° to 250°.

19. An oil-flooded screw compressor for high input power comprising a male rotor (2) having essentially convex lobe flanks featuring four, five or six lobes;

a female rotor (3) having essentially concave lobe flanks featuring six or seven lobes, a drive-shaft end (5) formed at the male rotor (2); wherein the male rotor (2) and the female rotor (3) form a rotor pair;

a suction-housing section (12) having at least parts of a suction channel (4) for passing of a working fluid into interlobe spaces of the rotor pair;

a rotor-housing section (13) at least partially enclosing a profile section of the male rotor (2) and of the female rotor (3);

a discharge-housing section (14) having at least an outlet port for passing a gas out of the interlobe spaces of the rotor pair due to rotation of the male rotor (2) and of the female rotor (3), and a discharge channel, wherein the suction housing section (12), the rotor housing section (13), and the discharge housing section (14) enclose the male rotor (2) and the female rotor (3);

a ratio L/A between a length L of a profile section of the male rotor (2) and of the female rotor (3) and distance A between axes of the rotor pair, which ratio L/A determines a bearing load, is decreased by shortening the profile sections of the male rotor (2) and of the female rotor (3); and an intermediate plate (7) fixed adjacent to the suction side of the profile section of the rotor pair relative to the rotor-housing section (13) containing parts of the suction channel (4) with inlet port (6), sealing contactless an end face of the profile sections of the rotor pair, and filling appropriately a space formed by shortening of the profile sections of the rotor pair;

wherein the intermediate plate (7) is arranged within the rotor-housing section (13);

wherein the intermediate plate (7) seals grooves of the rotor profile of the male rotor (2) and of the female rotor (3), and wherein only one intermediate plate (7) is furnished.

20. An oil-flooded screw compressor for high input power comprising a male rotor (2) having essentially convex lobe flanks featuring four, five or six lobes;

a female rotor (3) having essentially concave lobe flanks featuring six or seven lobes, a drive-shaft end (5) formed at the male rotor (2); wherein the male rotor (2) and the female rotor (3) form a rotor pair;

a suction-housing section (12) having at least parts of a suction channel (4) for passing of a working fluid into interlobe spaces of the rotor pair;

a rotor-housing section (13) at least partially enclosing a profile section of the male rotor (2) and of the female rotor (3);

a discharge-housing section (14) having at least an outlet port for passing a gas out of the interlobe spaces of the rotor pair due to rotation of the male rotor (2) and of the female rotor (3), and a discharge channel, wherein the suction housing section (12), the rotor housing section (13), and the discharge housing section (14) enclose the male rotor (2) and the female rotor (3);

a ratio L/A between a length L of a profile section of the male rotor (2) and of the female rotor (3) and distance A between axes of the rotor pair, which ratio L/A determines a bearing load, is decreased by shortening the profile sections of the male rotor (2) and of the female rotor (3); and an intermediate plate (7) fixed adjacent to the suction side of the profile section of the rotor pair relative to the rotor-housing section (13) containing parts of the suction channel (4) with inlet port (6), sealing contactless an end face of the profile sections of the rotor pair, and filling appropriately a space formed by shortening of the profile sections of the rotor pair;

wherein the intermediate plate (7) is arranged within the rotor-housing section (13);

wherein the intermediate plate (7) is a single piece of planar material;

wherein the single piece is disposed between a first shaft of the male rotor (2) and a second shaft of the female rotor (3); wherein a first contour (22) of the intermediate plate follows closely a round periphery of the first shaft over an angle of more than 60 degrees;

wherein a second contour (23) of the intermediate plate (7) follows closely around a periphery of the second shaft over an angle of more than 60 degrees;

wherein more than 90 percent of the intermediate plate (7) is disposed on one side of a connection line between axes of male rotor (2) and female rotor (3).

21. An oil-flooded screw compressor for high input power comprising a male rotor (2) having essentially convex lobe flanks featuring four, five or six lobes;

a female rotor (3) having essentially concave lobe flanks featuring six or seven lobes, a drive-shaft end (5) formed at the male rotor (2); wherein the male rotor (2) and the female rotor (3) form a rotor pair;

a suction-housing section (12) having at least parts of a suction channel (4) for passing of a working fluid into interlobe spaces of the rotor pair;

a rotor-housing section (13) at least partially enclosing a profile section of the male rotor (2) and of the female rotor (3);

a discharge-housing section (14) having at least an outlet port for passing a gas out of the interlobe spaces of the rotor pair due to rotation of the male rotor (2) and of the female rotor (3), and a discharge channel, wherein the suction housing section (12), the rotor housing section (13), and the discharge housing section (14) enclose the male rotor (2) and the female rotor (3);

an intermediate plate (7) fixed adjacent to the suction side of the profile section of the rotor pair relative to the rotor-housing section (13) containing parts of the suction channel (4) with inlet port (6), sealing contactless an end face of the profile sections of the rotor pair.

22. The screw compressor according to claim 21 wherein the intermediate plate (7) furnishes a location for parts of an oil return channel (20) for oil drainage from shaft seals to grooves of the rotor profile of the male rotor (2) and of the female rotor (3).

* * * * *